US011040922B2

(12) United States Patent
Matzger et al.

(10) Patent No.: US 11,040,922 B2
(45) Date of Patent: Jun. 22, 2021

(54) HYDROGEN PEROXIDE SOLVATES OF ENERGETIC MATERIALS

(71) Applicant: THE REGENTS OF THE UNIVERSITY OF MICHIGAN, Ann Arbor, MI (US)

(72) Inventors: Adam Matzger, Ann Arbor, MI (US); Jonathan C. Bennion, Lee, NH (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 473 days.

(21) Appl. No.: 16/023,855

(22) Filed: Jun. 29, 2018

(65) Prior Publication Data

US 2019/0002361 A1 Jan. 3, 2019

Related U.S. Application Data

(60) Provisional application No. 62/527,617, filed on Jun. 30, 2017.

(51) Int. Cl.

| | |
|---|---|
| ***C06B 25/34*** | (2006.01) |
| ***C06B 45/00*** | (2006.01) |
| *C06B 25/00* | (2006.01) |
| *D03D 23/00* | (2006.01) |
| *D03D 43/00* | (2006.01) |

(52) U.S. Cl.

CPC ..... *C06B 25/34* (2013.01); *C06B 45/00* (2013.01)

(58) Field of Classification Search

USPC ..... 149/2, 88, 92, 109.2, 109.4, 109.6

See application file for complete search history.

(56) References Cited

U.S. PATENT DOCUMENTS

| | | | | |
|---|---|---|---|---|
| 3,830,674 | A * | 8/1974 | Randolph | C06B 27/00 149/19.3 |
| 5,516,970 | A * | 5/1996 | Miller | B01J 19/123 588/309 |
| 6,652,682 | B1 * | 11/2003 | Fawls | B82Y 30/00 149/22 |
| 6,984,273 | B1 * | 1/2006 | Martin | C06B 47/00 149/1 |
| 9,353,456 | B2 | 5/2016 | Muscatelli et al. | |
| 2002/0121081 | A1 | 9/2002 | Cesaroni et al. | |
| 2016/0033250 | A1 | 2/2016 | Matzger et al. | |

OTHER PUBLICATIONS

Bennion, Jonathan C. et al., "Hydrogen Peroxide Solvates of 2,4,6,8,10,12-Hexanitro-2,4,6,8,10,12-hexaazaisowurtzitane." Angewandte Chemie, vol. 55, No. 42, pp. 13118-13121 (2016).

Bolton, Onas et al., "High Power Explosive with Good Sensitivity: A 2:1 Cocrystal of Cl-20:HMX." Crystal Growth & Design, vol. 12, No. 9, pp. 4311-4314 (2012).

(Continued)

*Primary Examiner* — James E McDonough

(74) *Attorney, Agent, or Firm* — Harness, Dickey & Pierce, P.L.C.

(57) ABSTRACT

A crystalline composition including an energetic material and hydrogen peroxide, both having observable electron density in a crystal structure of the composition, is provided. Methods of making the crystalline composition are also provided.

20 Claims, 11 Drawing Sheets

CL-20

HP

(56) References Cited

OTHER PUBLICATIONS

Bolton, Onas et al., "Improved Stability and Smart-Material Functionality Realized in an Energetic Cocrystal." Angewandte Chemie, vol. 50, No. 38, pp. 8960-8963 (2011).
Bonifacio, S. et al., "Novel Structured Catalysts for Hydrogen Peroxide Decomposition in Monopropellant and Hybrid Rockets." Journal of Propulsion and Power, vol. 29, No. 5, pp. 1130-1137 (2013).
Gamage, Nipuni-Dhanesha H. et al., "Highly Energetic, Low Sensitivity Aromatic Peroxy Acids." Chemistry—A European Journal, vol. 22, No. 8, pp. 2582-2585 (2016).
Gamage, Nipuni-Dhanesha H. et al., "Less sensitive oxygen-rich organic peroxides containing geminal hydroperoxy groups." Chemical Communications, vol. 51, No. 68, pp. 13298-13300 (2015).
Landenberger, Kira B. et al., "Cocrystal Engineering of a Prototype Energetic Material: Supramolecular Chemistry of 2,4,6-Trinitrotoluene." Crystal Growth & Design, vol. 10, No. 12, pp. 5341-5347 (2010).
Landenberger, Kira B. et al., "Cocrystals of 1,3,5,7-Tetranitro-1,3,5,7-tetrazacyclooctane (HMX)." Crystal Growth & Design, vol. 12, No. 7, pp. 3603-3609 (2012).
Landenberger, Kira B. et al., "Energetic-Energetic Cocrystals of Diacetone Diperoxide (DADP): Dramatic and Divergent Sensitivity Modifications via Cocrystallization." Journal of the American Chemical Society, vol. 137, No. 15, pp. 5074-5079 (2015).
Landenberger, Kira B. et al., "Two Isostructural Explosive Cocrystals with Significantly Different Thermodynamic Stabilities." Angewandte Chemie, vol. 52, No. 25, pp. 6468-6471 (2013).
Matyáš Robert et al., "Study of TATP: Influence of Reaction Conditions on Product Composition." Propellants, Explosives, Pyrotechnics, vol. 35, No. 1, pp. 31-37 (2010).
Millar, David I. A. et al., "Crystal engineering of energetic materials: Co-crystals of CI-20." CrystEngComm, vol. 14, No. 10, pp. 3742-3749 (2012).
Romantsova, O. V. et al., "Safety issues of high-concentrated hydrogen peroxide production used as rocket propellant." Acta Astronautica, vol. 109, pp. 231-234 (2015).
Rusek, John J., "New decomposition catalysts and characterization techniques for rocket-grade hydrogen peroxide." Journal of Propulsion and Power, vol. 12, No. 3, pp. 574-579 (1996).
Spek, Anthony L., "Platon Squeeze: a tool for the calculation of the disordered solvent contribution to the calculated structure factors." Acta Crystallographica Section C, vol. 71, No. 1, pp. 9-18 (2015).
Wierzbicki, Andrzej et al., "Density Functional Theory and X-ray Investigations of P- and M-Hexamethylene Triperoxide Diamine and Its Dialdehyde Derivative." The Journal of Physical Chemistry A, vol. 105, No. 38, pp. 8763-8768 (2001).

* cited by examiner

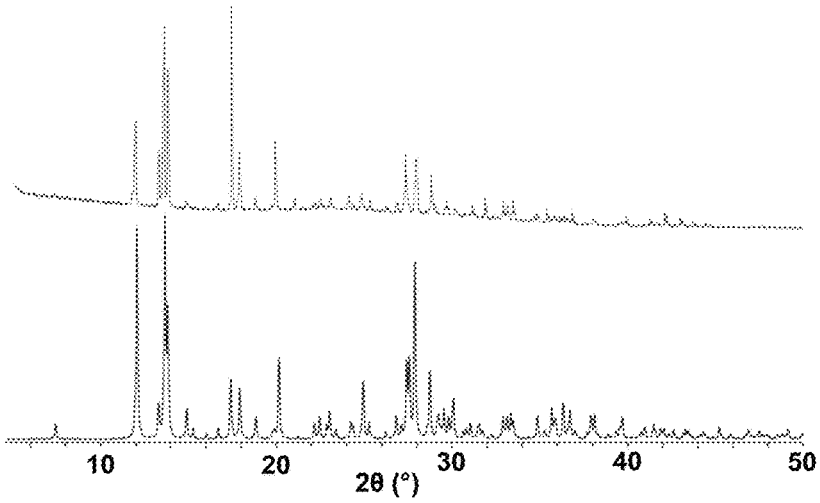
Fig. 2A
Fig. 2B
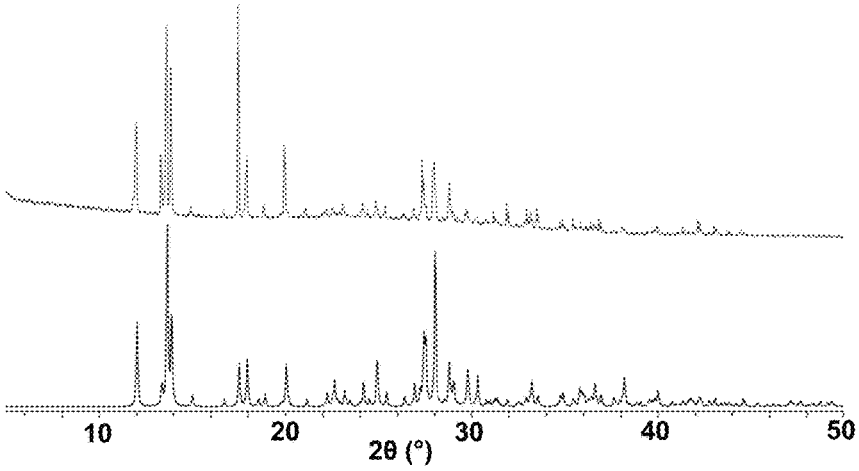
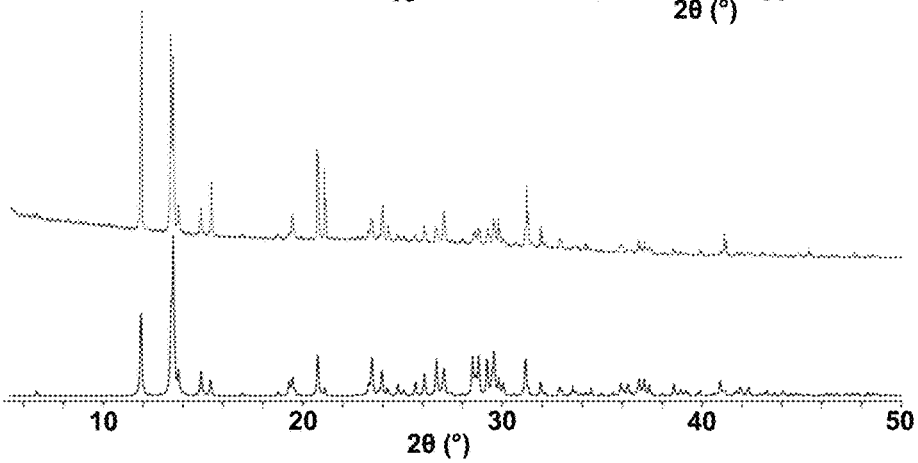
Fig. 2C

HYDROGEN PEROXIDE SOLVATES OF ENERGETIC MATERIALS

CROSS-REFERENCE TO RELATED APPLICATIONS

This application claims the benefit of U.S. Provisional Application No. 62/527,617, filed on Jun. 30, 2017. The entire disclosure of the above application is incorporated herein by reference.

GOVERNMENT SUPPORT

This invention was made with government support under W911NF-13-1-0387 awarded by the U.S. Army Research Laboratory's Army Research Office. The government has certain rights in the invention.

INTRODUCTION

In energetic materials, the formation of various (hemi-, mono-, di-, etc.) hydrated materials is a problem that is often encountered. For example, the widely used energetics octahydro-1,3,5,7-tetranitro-1,3,5,7-tetrazocine (HMX) and 2,4,6,8,10,12-hexanitro-2,4,6,8,10,12-hexaazaisowurtzitane (CL-20) both form hydrates, γ-HMX and α-CL-20, which have inferior detonation properties compared to the respective high density forms, β-HMX and ε-CL-20.

The detonation properties (velocity and pressure) are dependent on the density of a material (higher density translates to higher detonation velocity/pressure). While a hydrate may have a high density, hydration ultimately reduces the effective density of the energetic component(s) and as a result diminishes the performance of the material.

A positive oxygen balance (OB) denotes that there is excess oxygen in the system after full conversion, whereas a negative OB refers to an insufficient amount of oxygen and typically results in the generation of carbon soot and lower oxidized, toxic gases (CO, NO). The more negative the OB, the less gas that is generated from the detonation and as a result, the brisance or shattering effect of the material is diminished.

The majority of traditional energetic materials possess a negative OB with respect to $CO_2$: CL-20 (−11%), HMX (−22%) and 2,4,6-trinitrotoluene [TNT] (−74%). The inclusion of water molecules into the lattice of an energetic does not lead to increased OB because the oxygen atoms are already bonded to two hydrogens. Hydrogen Peroxide has low toxicity, minimal environmental impact compared to traditional perchlorate oxidizers, and is also impact/shock insensitive in concentrated form.

SUMMARY

This section provides a general summary of the disclosure, and is not a comprehensive disclosure of its full scope or all of its features.

In various aspects, the current technology provides a crystalline composition including an energetic material and hydrogen peroxide, both having observable electron density in a crystal structure of the composition.

In one aspect, the energetic material is 2,4,6,8,10,12-hexanitro-2,4,6,8,10,12-hexaazaisowurtzita (CL-20).

In one aspect, the crystalline composition has a crystal structure having space group C2/c.

In one aspect, the crystalline composition is characterized by having a peak in the Raman spectrum at 872 $cm^{-1}$, 3517 $cm^{-1}$, or both.

In one aspect, the crystalline composition has a crystal structure having space group Pbca.

In one aspect, the crystalline composition is characterized by having a peak in the Raman spectrum at 866 $cm^{-1}$, 3557 $cm^{-1}$, or both.

In one aspect, the energetic material is 5,5'-Dinitro-2H,2H'-3,3'-bi-1,2,4-triazole (DNBT).

In one aspect, the energetic material is an organic nitro compound.

In one aspect, the crystalline composition has an energetic material:hydrogen peroxide ratio of from about 1:1 to about 10:1.

In one aspect, the crystalline composition has an oxygen balance that is higher than a second oxygen balance of a corresponding water solvate including the same energetic material, but including water instead of hydrogen peroxide.

In various aspects, the current technology also provides a composition including a crystalline solvate, the crystalline solvate including an organic nitro compound, nitrate ester, nitramine, or azole, and hydrogen peroxide.

In one aspect, the organic nitro compound, nitrate ester, nitramine, or azole is an energetic material selected from the group consisting of 2,4,6,8,10,12-hexanitro-2,4,6,8,10,12-hexaazaisowurtzitane (CL-20); 5-nitro triazol-3-one (NTO); 2,4,6-trinitrotoluene (TNT); 1,3,5,7-tetranitro-1,3,5,7-tetrazocane (HMX); trinitro triamino benzene (TATB); 3,5-dinitro-2,6-bis-picrylamino pyridine (PYX); nitroglycerine (NG); ethylene glycol dinitrate (EGDN); ethylenedinitramine (EDNA); diethylene glycol dinitrate (DEGDN); Semtex; Pentolite; trimethylol ethyl trinitrate (TMETN); tetryl, hexahydro-1,3,5-trinitro-1,3,5-triazine (RDX); pentaerythritol tetranitrate (PETN); 2,2,2-trinitroethyl-4,4,4-trinitrobutyrate (TNETB); methylamine nitrate; nitrocellulose; $N^3,N^3,N'^3,N'^3,N^7,N^7,N'^7,N'^7$-octafluoro-1,5-dinitro-1,5-diazocane-3,3,7,7-tetraamine (HNFX); nitroguanidine; hexanitrostilbene; 2,2-dinitroethene-1,1-diamine (FOX-7); tetranitromethane (TNM); hexanitroethane (HNE); 5,5'-Dinitro-2H,2H'-3,3'-bi-1,2,4-triazole (DNBT); dinitrourea; picric acid; and combinations thereof.

In one aspect, the energetic material is CL-20.

In one aspect, the crystalline solvate has a CL-20:hydrogen peroxide ratio of about 2:1.

In one aspect, the crystalline solvate has a structure that is orthorhombic.

In one aspect, the crystalline solvate has a structure that is monoclinic.

In one aspect, the crystalline solvate has an oxygen balance that is higher than an oxygen balance of each of hydrated CL-20 (α-CL-20) and pure CL-20.

In various aspects, the current technology yet further provides a method of making a crystalline solvate containing hydrogen peroxide. The method includes precipitating the solvate from a solution containing the hydrogen peroxide and an energetic material that is a nitrate ester, an organic nitro compound, a nitramine, or an azole In one aspect, the solution containing the hydrogen peroxide further comprises an organic solvent.

In one aspect, the precipitating includes at least one of lowering a temperature of the solution, adding another solvent in which the energetic material is less soluble to the solution, and evaporating a portion of the organic solvent

DRAWINGS

The drawings described herein are for illustration purposes only and are not intended to limit the scope of the present disclosure in any way.

FIG. 2A shows a powder X-ray diffraction pattern of 1 (orthorhombic) and a simulated structure of α-CL-20 from a crystallographic information file (CIF).

FIG. 2B shows a powder X-ray diffraction pattern of 1 (orthorhombic) and a simulated structure of 1 from a CIF.

FIG. 2C shows a powder X-ray diffraction pattern of 2 (monoclinic) and a simulated structure of 2 from a CIF.

Figure 9:
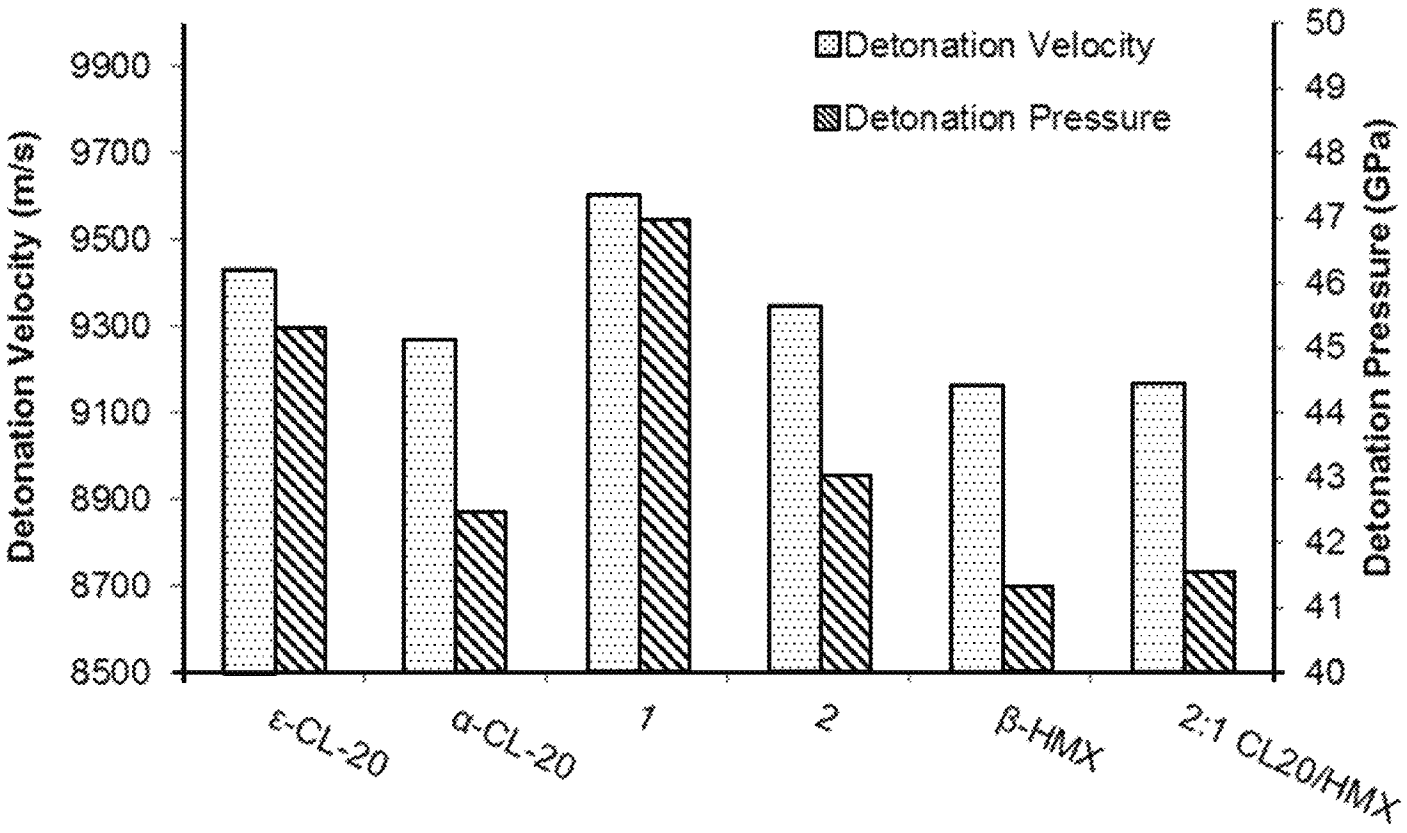

FIG. 9 shows detonation parameters (velocity and pressure) of ε-CL-20, α-CL-20, 1, 2, β-HMX and 2:1 CL-20/HMX predicted with Cheetah 7.0 using the room-temperature (295 K) crystallographic densities of each material; detonation parameters for 1 at 2.033 $g/cm^3$ are calculated by extrapolating the detonation velocity vs. density and detonation pressure vs. density squared from the values determined at 99-90% of the crystallographic density given that the theoretical max density (% TMD) maxed out at only 2.013 $g/cm^3$.

DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges. As referred to herein, ranges are, unless specified otherwise, inclusive of endpoints and include disclosure of all distinct values and further divided ranges within the entire range. Thus, for example, a range of "from A to B" or "from about A to about B" is inclusive of A and B.

Example embodiments will now be described more fully with reference to the accompanying drawings The current technology provides crystalline solid compositions that are characterized as solvates of energetic materials with hydrogen peroxide (HP). The energetic materials contain nitro groups ($NO_2$) and are categorized as nitrate esters, nitramanes, azoles, or organic nitro compounds. The compositions are further characterized by the presence in the crystal structure of ordered hydrogen peroxide molecules, with observable hydrogen bonding between the hydrogen atoms of hydrogen peroxide and oxygen atoms on the nitro groups of the energetic materials. Therefore, the compositions have observable electron density in the crystal structure of the composition.

In the description that follows, depending on context, the term "solvate(s)" is used as a shorthand way to designate the crystalline solid compositions that contain an energetic material (i.e., a solute molecule) and a hydrogen peroxide (HP) molecule (i.e., a solvent molecule, wherein the solvent molecule is hydrogen peroxide). Accordingly, a solvate composition according to the current technology is also referred to as a "hydrogen peroxide solvate" or as a "HP solvate." Unless specified otherwise, the term "solvate" used herein refers to the hydrogen peroxide solvate.

As non-limiting examples, the energetic materials include 2,4,6,8,10,12-hexanitro-2,4,6,8,10,12-hexaazaisowurtzitane (CL-20); 5-nitro triazol-3-one (NTO); 2,4,6-trinitrotoluene (TNT); 1,3,5,7-tetranitro-1,3,5,7-tetrazocane (HMX); trinitro triamino benzene (TATB); 3,5-dinitro-2,6-bis-picrylamino pyridine (PYX); nitroglycerine (NG); ethylene glycol dinitrate (EGDN); ethylenedinitramine (EDNA); diethylene glycol dinitrate (DEGDN); Semtex; Pentolite; trimethylol ethyl trinitrate (TMETN); tetryl, hexahydro-1,3,5-trinitro-1,3,5-triazine (RDX); pentaerythritol tetranitrate (PETN); 2,2,2-trinitroethyl-4,4,4-trinitrobutyrate (TNETB); methylamine nitrate; nitrocellulose; $N^3,N^3,N'^3,N'^3,N^7,N^7,N'^7,N'^7$-octafluoro-1,5-dinitro-1,5-diazocane-3,3,7,7-tetraamine (HNFX); nitroguanidine; hexanitrostilbene; 2,2-dinitroethene-1,1-diamine (FOX-7); dinitrourea; picric acid, and combinations thereof. In various aspects, the energetic material is selected from the group consisting of 2,4,6-trinitrotoluene (TNT), 1,3,5,7-tetranitro-1,3,5,7-tetrazocane (HMX), and combinations thereof. Further examples include tetranitromethane (TNM), hexanitroethane (HNE), 5,5'-Dinitro-2H,2H'-3,3'-bi-1,2,4-triazole (DNBT), combinations thereof.

The solvates of the current technology have a "solvate ratio." As used herein, the "solvate ratio" is a ratio between the amount of solute molecules (e.g., molecules of the energetic material) to the amount of solvent molecules (e.g., molecules of hydrogen peroxide or water, as discussed below) in a solvate. The solvate ratio is expressed, for example, as an energetic material:solvent ratio or an energetic material:hydrogen peroxide ratio.

In some aspects, a hydrogen peroxide solvate composition of the current technology has a "corresponding water solvate." As used herein, a "corresponding water solvate" is a solvate comprising the same solute molecule (i.e., energetic material) as the hydrogen peroxide solvate, but having water as the solvent molecule (instead of hydrogen peroxide). In some embodiments, the hydrogen peroxide solvate and its corresponding water solvate are polymorphic, i.e., have at least one of a different energetic material:solvent ratio and a different crystal structure. In other embodiments, the hydrogen peroxide solvate and its corresponding water solvate are isostructures, i.e., have the same energetic material:solvent ratio and the same crystal structure. The HP solvates of the current technology have an energetic material:HP ratio of from about 1:1 to about 10:1, such as about 1:1, about 2:1 (about 1:0.5), about 3:1 (about 1:0.333), about 4:1 (about 1:0.25), about 5:1 (about 1:0.2), about 6:1, about 7:1, about 8:1, about 9:1, or about 10:1.

Many energetic materials have a negative oxygen balance (OB). Such materials are inefficient, i.e., they generate carbon soot and a low amount of oxidized, toxic gas. To account for this inefficiency, energetic materials with a negative OB are often combined with an adjunct oxidizer, such as perchlorate. As used here, an "adjunct oxidizer" is an oxidizer that is added to an energetic material and does not include an oxidizer that is included within the energetic material itself. However, many oxidizers, including perchlorate, are toxic. The HP solvates of the current technology have an increased OB relative to a second OB of their corresponding water solvate. This increase in OB is contributed to an extra oxygen atom that each HP molecule provides to the solvate relative to water. When the HP solvate has an increased OB relative to its water solvate, the use of toxic adjunct oxidizing agents, such as perchlorate, is reduced or eliminated. Therefore, in some embodiments, a composition comprising an HP solvate is substantially free of an adjunct oxidizing agent. As used herein, the term "substantially free" means that the composition comprising the HP solvates includes an adjunct oxidizing agent at a concentration of less than or equal to about 10 wt. %, less than or equal to about 5 wt. %, less than or equal to about 2 wt. %, less than or equal to about 1 wt. %, and in certain variations, less than or equal to about 0.5 wt. %. In some embodiments, the HP solvate is free of an adjunct oxidizing agent, i.e., does not include an adjunct oxidizing agent whatsoever (the HP solvate includes 0 wt. % adjunct oxidizer).

The HP solvates of the current technology have properties that differ from their corresponding water solvates. Non-limiting examples of these properties include OB (as described above), density, thermal properties (including endothermic peak temperature and decomposition temperature), sensitivity, and detonation properties (including detonation velocity, detonation pressure). A property of an HP solvate may be increased or decreased relative to the property in a corresponding water solvate. For example, when they are isostructures, an HP solvate has a higher density than a second density of the HP solvate's corresponding water solvate. On the other hand, when they are polymorphs, an HP solvate has a density that may be higher or lower than a second density of the HP solvate's corresponding water solvate Crystalline solvates containing hydrogen peroxide and energetic materials may be prepared by precipitation, evaporation, or slurry conversion from solutions containing both components. In an embodiment, an energetic material is dissolved in a solvent to make a liquid solution, and then liquid hydrogen peroxide is added to dilute the solvent. The concentration of energetic material in the solvent and the amount of hydrogen peroxide added to dilute the solvent can be varied if desired to find conditions under which the observed precipitate contains both the energetic material and hydrogen peroxide. In various embodiments, the solution comprises a solvent and hydrogen peroxide at a solvent:HP ratio of from about 1:50 to about 50:1, such as about 1:50, about 1:40, about 1:30, about 1:20, about 1:10, about 1:9, about 1:8, about 1:7, about 1:6, about 1:5, about 1:4, about 1:3, about 1:2, about 1:1, about 2:1, about 3:1, about 4:1, about 5:1, about 6:1, about 7:1, about 8:1, about 9:1, about 10:1, about 20:1, about 30:1, about 40:1, or about 50:1.

A variety of solvents can be used for forming the solution from which the solvates of the current teachings will precipitate, as long as they can dissolve the energetic material at a suitable concentration and will not react to an unsuitable extent with hydrogen peroxide. In various embodiments, the solvent is a polar organic solvent or a non-polar organic solvent. The polar organic solvent can be aprotic, protic, or a combination thereof. Non-limiting examples of aprotic polar solvents include acetonitrile, benzonitrile, cyclohexanone, acetone, pyridine, N',N-dimethylformamide (DMF), dimethylsulfoxide (DMSO), dichloromethane (DCM), tetrahydrofuran (THF), ethyl acetate, N-methylpyrrolidone, propylene carbonate (PC), hexamethylphosphoric triamide (HMPT), 1,4-dioxane, and combinations thereof. Non-limiting examples of protic polar solvents include ammonia, formic acid, n-butanol, isopropanol, nitromethane, ethanol, methanol, acetic acid, ethylene glycol, diethylene glycol, water, and combinations thereof. Non-limiting examples of nonpolar organic solvents include pentane, hexane, heptane, carbon tetrachloride, cyclohexane, benzene, p-xylene, toluene, chloroform, diethyl ether, carbon disulfide, and combinations thereof. When combined with hydrogen peroxide, it is understood that certain ratios of solvent to hydrogen peroxide to water (solvent:HP:water) should be avoided in view of the detonation triangle, as known in the art.

Precipitation of the solvate from solutions of energetic materials can also be induced by lowering the temperature, adding other solvents in which the energetic material is less soluble, evaporating some, i.e., a portion, of the solvent, and the like. In various embodiments, hydrogen peroxide is a major component (more than 50% by weight) of the solution from which the solvate is crystallized.

The presence or absence of hydrogen peroxide at crystallographic sites in the precipitates can be demonstrated or confirmed, for example, by measuring the crystallographic density of the crystalline precipitate and comparing the crystallographic density to known crystal structures, including known unit cell dimensions, of the energetic materials (i.e., a structure not containing hydrogen peroxide) or of their known hydrates. Theoretical calculations such as those known in the field as PLATON/SQUEEZE calculations can also provide observations from which it can be deduced whether or not a hydrogen peroxide solvate molecule is present in the crystalline precipitate. Raman or IR spectroscopy and various other chemical analyses can also be used to confirm the presence or not of hydrogen peroxide at solvate sites in the crystal. Non-limiting examples of use of all of these techniques are given in the Examples section below.

Sometimes a crystal solvate having a first crystal structure will form by precipitation from a solvent system containing hydrogen peroxide. The observed precipitate in this case may represent a kind of kinetically favored structure. In certain embodiments, allowing the solvate to incubate within the solvent system containing hydrogen peroxide will cause the crystal to transform from the first crystal structure to a second crystal structure. This phenomenon is also illustrated in the Examples section where an orthorhombic crystal precipitates from a solvent containing hydrogen peroxide and transforms into a monoclinic polymorph after further incubation within the solvent containing hydrogen peroxide.

The solvates of the current teachings are themselves energetic materials that can be formulated into otherwise conventional explosive compositions. That is, the solvates of the current teachings can be used alone or in combination with other explosive materials. In various embodiments, the hydrogen peroxide solvates are provided in substantially pure form or in combination with one or more group A initiating explosives. Such compositions include, as non-limiting examples, combinations of the solvate crystal with one or more of CL-20, CP (5-Cyanotetrazolpentaamine Cobalt III perchlorate), dry HMX (Cyclotetramethylene tetranitramine), lead azide, lead stiffnate, mercury fulminate, dry nitrocellulous, dry PETN (Pentaerythritol tetranitrate), dry RDX (Cyclotrimethylene trinitramine), TATNB (Trizidotrinitrobenzene), dry HMX (Cyclotetramethylene tetranitramine), and DNBT.

In other embodiments, the solvates of the current teachings are combined with one or more Group D explosives (explosives without their own means of initiation). As non-limiting examples, these include combinations of the solvates with one or more of ammonium picrate, baratol, black powder, boracitol, wet CL-20 (Hexanitrohexaazaisowurtzitane), cyclotols (≤85% RDX), DATB (Diaminotrinitrobenzene), bis-Dinitropropyl adipate, bis-Dinitropropyl glutarate, bis-Dinitropropyl maleate, Dinitropropane, Dinitropropanol, Dinitropropyl acrylate monomer (DNPA), Dinitroproply acrylate polymer (PDNPA), Explosive D, GAP (Glyceryl azide polymer), wet HMX (Cyclotetramethylene tetranitramine), HMX/wax (formulated with at least 1% wax), wet or dry HNS (Hexanitrostilbene), Methyl dinitropentanoate, NG/TA (Nitroglycerine-triacetine), wet Nitrocellulose, Nitroguanidine (NQ), Octol (≤75% HMX), Pentolite, wet PETN (Pentaerythritol tetranitrate), PETN/extrudable binder, PGN (Polyglycidyl nitrate), Plastic-bonded explosive, PBX (a SC/HC Group D formulated with a desensitizing binder), Potassium picrate, wet RDX (Cyclotrimethylene trinitramine), TATB (Triamino trinitrobenzene), TATB/DATB mixtures, TEGDN (Triethylene glycol dinitrate), TMETN (Trimethylolethane trinitrate), TNAZ (Trinitoazetidine), and TNT (Trinitrotoluene).

Embodiments of the present technology are further illustrated through the following non-limiting examples.

Example 1

Two exemplary polymorphic hydrogen peroxide (HP) solvates of 2,4,6,8,10,12-hexanitro-2,4,6,8,10,12-hexaazaisowurtzitane (CL-20) are obtained using hydrated α-CL-20 as a guide. These HP solvates have high crystallographic densities (1.96 and 2.03 g/cm$^3$, respectively), high predicted detonation velocities and pressures (with one solvate possessing greater performance that that of ε-CL-20) and sensitivity similar to that of ε-CL-20.

Experimental

Materials:

2,4,6,8,10,12-Hexanitro-2,4,6,8,10,12-hexaazaisowurtzitane (CL-20) is used as received from Picantinny Arsenal. Concentrated 98% hydrogen peroxide (HP) is used as received from PeroxyChem LLC.

Crystallization:

Both polymorphic solvates of CL-20 (1 and 2) are initially obtained from 1:1 acetonitrile/hydrogen peroxide solutions, with a small amount (about 5 mg) of CL-20 dissolved, by slow evaporation and then conditions for their pure growth is determined. Similarly, the hydrated form of α-CL-20 is obtained by slow evaporation by dissolving a small amount (about 5 mg) of CL-20 in a 1:1 acetonitrile/DI $H_2O$ solution. The orthorhombic solvate is easily scaled up through the slow addition of hydrogen peroxide to the solution of CL-20. The monoclinic solvate is scaled up with the use of solvent mediated transformation in a slurry of the pure components at room temperature, see below.

2:1 CL-20/HP (1) Orthorhombic.

A 4 mL glass vial is loaded with 30 mg of ε-CL-20 (0.0685 mmol) which is dissolved in 300 μL of dry acetonitrile. To this solution is added 300 μL of concentrated $H_2O_2$ at which point the formation of thin plates of 1 is observed by optical microscopy. The vial is sealed and its contents stirred gently for 15 minutes, before the crystals are collected. This solid is determined to be the 2:1 CL-20/hydrogen peroxide orthorhombic solvate by both Raman spectroscopy and powder X-ray diffraction.

20/HP (2) Monoclinic.

A 4 mL glass vial is loaded with 30 mg of ε-CL-20 (0.0685 mmol) which is dissolved in 200 μL of dry acetonitrile. To this solution is added 500 μL of concentrated $H_2O_2$, at which point a mixture of orthorhombic and monoclinic solvates is obtained. The vial is sealed and the contents stirred gently for 4 days, during which time the orthorhombic CL-20/hydrogen peroxide crystals disappear and only monoclinic CL-20/hydrogen peroxide remains by optical microscopy. This solid is determined to be 2:1 CL-20/hydrogen peroxide monoclinic solvate by both Raman spectroscopy and powder X-ray diffraction.

Raman Spectroscopy:

Raman spectra are collected using a Renishaw inVia Raman Microscope equipped with a Leica microscope, 633 nm laser, 1800 lines/mm grating, 50 μm slit and a RenCam CCD detector. Spectra are collected in extended scan mode with a range of 100-4000 $cm^{-1}$ and then analyzed using the WiRE 3.4 software package (Renishaw). Calibration is performed using a silicon standard.

Power X-Ray Diffraction (PXRD):

Powder X-ray diffraction patterns are collected on a Bruker D8 Advance diffractometer using Cu-Kα radiation (λ=1.54187 Å) and operating at 40 kV and 40 mA. Samples are prepared by finely grinding and packing into a depression of a glass slide. Powder patterns are collected by scanning 2θ from 5° to 50° with a step size of 0.02° and a step speed of 0.5 seconds. The data is processed using Jade 8 XRD Pattern Processing, Identification & Quantification analysis software (Materials Data, Inc.). The powder patterns are all compared to their respective simulated powder patterns from single crystal X-ray diffraction structures and are found to be in significant agreement with predicted patterns.

Single Crystal Structure Determination: Single crystal X-ray diffraction data for 1, 2 and α-CL-20 are collected using a Rigaku AFC10K Saturn 944+ CCD-based X-ray diffractometer equipped with a low temperature device and Micromax-007HF Cu-target micro-focus rotating anode (λ=1.54187 A) operated at 1.2 kW power (40 kV, 30 mA). X-ray intensities are measured at 85(1) K with the detector placed at a distance 42.00 mm from the crystal. The data is processed with CrystalClear 2.0 (Rigaku)[2] and corrected for absorption. The structures are solved and refined with a Bruker SHELXTL (version 2008/4) software package using direct methods. All non-hydrogen atoms are refined anisotropically with the hydrogen atoms placed in a combination of refined and idealized positions.

Cambridge Crystallographic Data Centre (CCDC) entries 1495519, 1495520, and 1495521 contain supplementary crystallographic data. These data are provided free of charge by the CCDC and are incorporated herein by reference in their entirety.

Differential Scanning Calorimetry (DSC):

Thermograms for each sample are recorded on a TA Instruments Q20 DSC equipped with a RCS90 chiller. All experiments are run in Tzero™ hermetic aluminum DSC pans under a nitrogen purge with a heating rate of 10° C./min, while covering the temperature range of 40° C. to 300° C. The instrument is calibrated using an indium standard. Thermograms are analyzed using TA Universal Analysis 2000, V 4.5A.

Thermogravimetric Analysis (TGA):

Thermograms for each sample are recorded on a TA Instruments Q50 TGA. All experiments are run in platinum TGA sample pans with a stainless steel mesh cover under a nitrogen purge of 50 mL/min with a heating rate of 10° C./min, while covering the temperature range of 35° C. to 450° C. The instrument is calibrated using the Curie points of alumel and nickel standards. Thermograms are analyzed using TA Universal Analysis 2000, V 4.5A.

Drop Weight Impact Sensitivity Analysis:

For the analysis of the sensitivity to impact, approximately 2 mg (±10%) of material for each sample is contained within nonhermetic DSC pans and then struck by a freefalling 5 lb. drop weight. A reproducible Dh50, height of the 50% probability of detonation, is obtained by utilizing the Bruceton Analysis (up-and-down method) with varying drop heights. For reference, the $Dh_{50}$ of ε-CL-20 and β-HMX are 29 and 55 cm, respectively.

Results and Discussion

Figure 1:
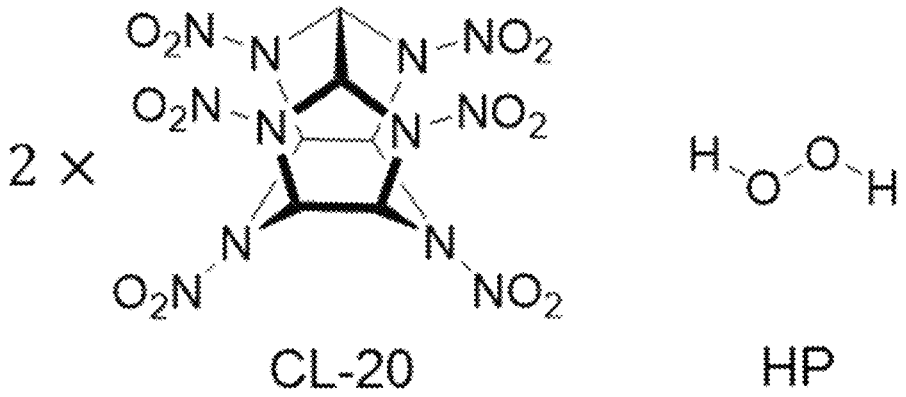
FIG. 1 shows chemical structures of pure components for CL-20 polymorphic solvates (1 (orthorhombic) and 2 (monoclinic)): CL-20 and hydrogen peroxide.

Provided here are exemplary solvates containing hydrogen peroxide and an energetic material. Non-limiting examples are two polymorphic solvates of CL-20 with hydrogen peroxide, orthorhombic (1) and monoclinic (2); both materials form in a 2:1 molar ratio of CL-20 and hydrogen peroxide (see FIG. 1 for pure component structures). These represent the first examples of solvates with hydrogen peroxide for any energetic material.

Figure 4C:
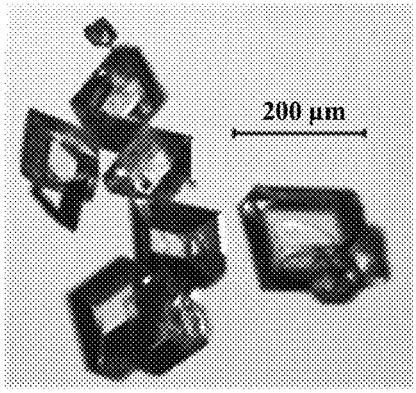
FIG. 4C shows typical rhombic habit morphology of the orthorhombic polymorph.
Figure 5B:
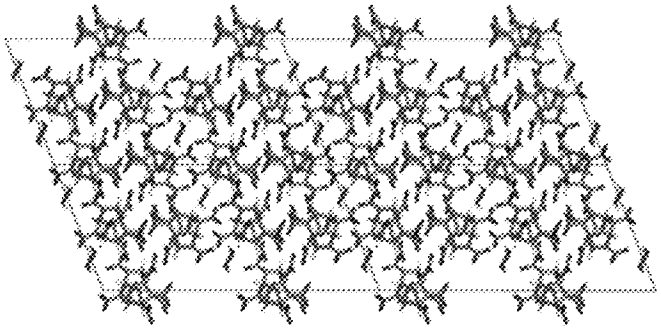
FIG. 5B shows a unit cell viewing down the a-axis for the 2:1 CL-20/hydrogen peroxide monoclinic solvate (2).
Figure 5C:
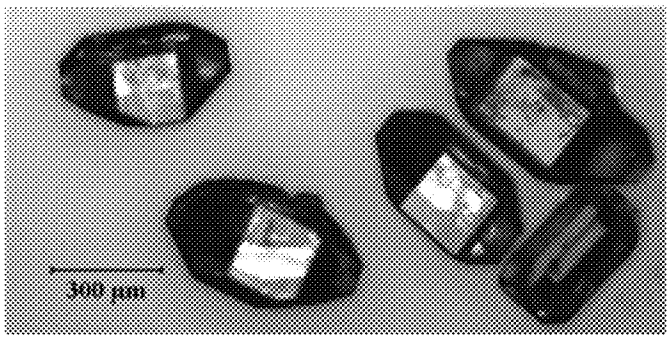
FIG. 5C shows a typical polyhedron habit morphology of the monoclinic polymorph.

The concomitant formation of 1 and 2 is initially observed from a 1:1 acetonitrile/hydrogen peroxide (>90% $H_2O_2$) solution. Solvate 1 exhibits a rhombic habit (see FIG. 4C), whereas 2 typically exhibits a polyhedron habit (see FIG. 5C), and these crystals are separated and analyzed by powder X-ray diffraction. FIGS. 2A, 2B, and 2C show X-ray diffractin patterns of 1 (top) and a simulated structure of α-CL-20 from a crystallographic information file (CRF; bottom), e (top) and a simulated structure of 1 from a CIF (bottom), and 2 (top) and a simulated structure of 2 from a CIF (bottom), respectively. The powder pattern of 1 is indistinguishable from α-CL-20 (FIGS. 2A and 2B), which suggests that the material is either simply α-CL-20 or an isostructural material with hydrogen peroxide replacing the water molecules as hypothesized. Solvate 2, on the other hand, is readily distinguishable from any of the other forms of CL-20 (FIG. 2C).

The crystal structures of 1 and 2 are elucidated and determined to be 2:1 CL-20/hydrogen peroxide solvates; crystallographic data are presented in Table 1 for α-CL-20, 1 and 2. Both materials have high crystallographic densities: 1 has a density of 2.033 $g/cm^3$ at 295 K and 2 has a density of 1.966 g/cm$^3$ at 295 K. When compared to α-CL-20 (1.970 g/cm$^3$ at 295 K), the isostructural material 1 possesses a superior density and 2 possesses a density similar to that of the hydrated material. The OB for both 1 and 2 is determined to be −8.79%, an improvement with respect to both α-CL-20 (−10.84%) and pure CL-20 (−10.95%). Therefore, 1 and 2 have an oxygen balance that is higher than oxygen balance of each of α-CL-20 and pure CL-20.

TABLE 1

Crystallographic Data for α-CL20 and CL-20 Solvates (Collected at 85 K)

| Material | α-CL-20 | 1 | 2 |
|---|---|---|---|
| Stoichiometry | 4:01 | 2:01 | 2:01 |
| Morphology | Plate | Rhombic | Polyhedron |
| Space Group | Pbca | Pbca | C2/c |
| a (Å) | 9.4765 (2) | 9.4751 (2) | 28.4497 (7) |
| b (Å) | 13.1394 (2) | 13.1540 (10) | 8.9596 (2) |
| c (Å) | 23.3795 (16) | 23.4266 (4) | 12.7807 (9) |
| α (°) | 90 | 90 | 90 |
| β (°) | 90 | 90 | 113.397 (8) |
| γ (°) | 90 | 90 | 90 |
| Volume (Å3) | 2911.11 | 2919.79 | 2989.9 |
| Z | 8 | 8 | 8 |
| ρcalc (g/cm$^3$) | 2.020 | 2.071 | 2.041 |
| Data/Parameter | 2669/287 | 2648/324 | 2696/312 |
| R1/wR2 | 3.46/9.38 | 3.28/8.82 | 4.10/9.49 |
| GOF | 1.008 | 1.058 | 1.134 |

One way of identifying the solvent content in a crystal structure is through the use of a PLATON/SQUEEZE calculation, which assesses the electron density contribution in the unit cell from the solvent. Both the hydrogen peroxide solvent present in the crystal structure of 1 and the $H_2O$ in α-CL-20 (for these calculations the crystal structure of α-CL-20 is redetermined) sit on the same inversion center, leading to uncertainty into the existence of the hydrogen peroxide in the material. The electron density is estimated to be 24 and 44 e$^-$/unit cell for α-CL-20 and 1, respectively. The electron density for α-CL-20 corresponds roughly to the two water molecules present in the unit cell (10 e$^-$/molecule), whereas the higher electron density of 44 electrons for 1 corresponds to the presence of hydrogen peroxide (18 eimolecule) in the isostructural material. The same routine is applied to 2 and the electron density is determined to be 79 e$^-$/unit cell, which corresponds closely to the four hydrogen peroxide molecules in the 2:1 CL-20 solvate. The higher electron density suggests the presence of a novel material compared to α-CL-20, but given the tendency of SQUEEZE to over-count electron density, additional investigation via Raman spectroscopy and chemical analysis is carried out to further support these results.

Figure 3A:
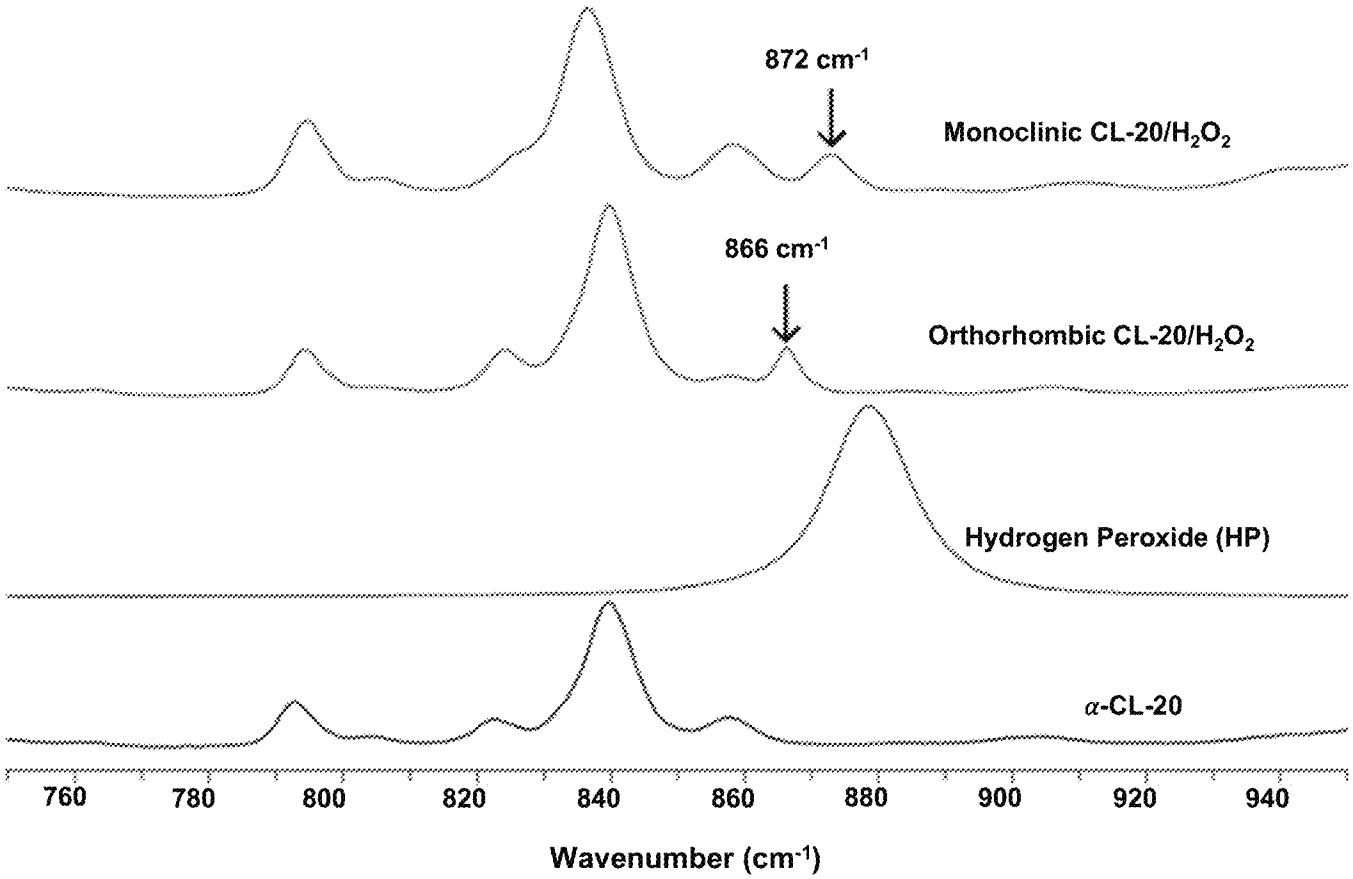
FIG. 3A shows Raman spectra (700-1000 $cm^{-1}$) of α-CL-20, concentrated hydrogen peroxide, 1 and 2. Pure hydrogen peroxide O—O peak is at 879 $cm^{-1}$.
Figure 3B:
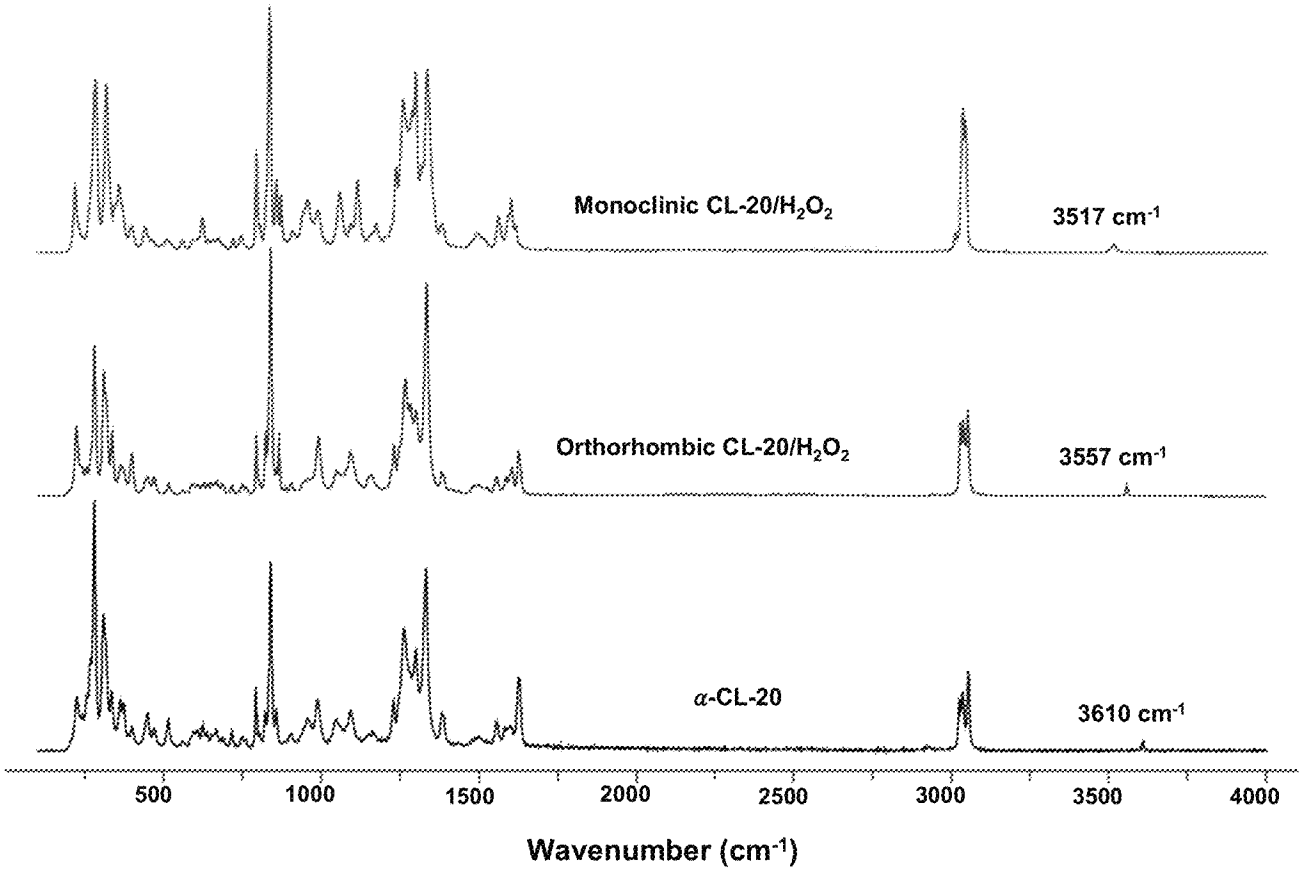
FIG. 3B shows full range Raman spectra (100-4000 $cm^{-1}$) of α-CL-20, concentrated hydrogen peroxide, 1 and 2. Pure hydrogen peroxide O—O peak is at 879 $cm^{-1}$.
Figure 3C:
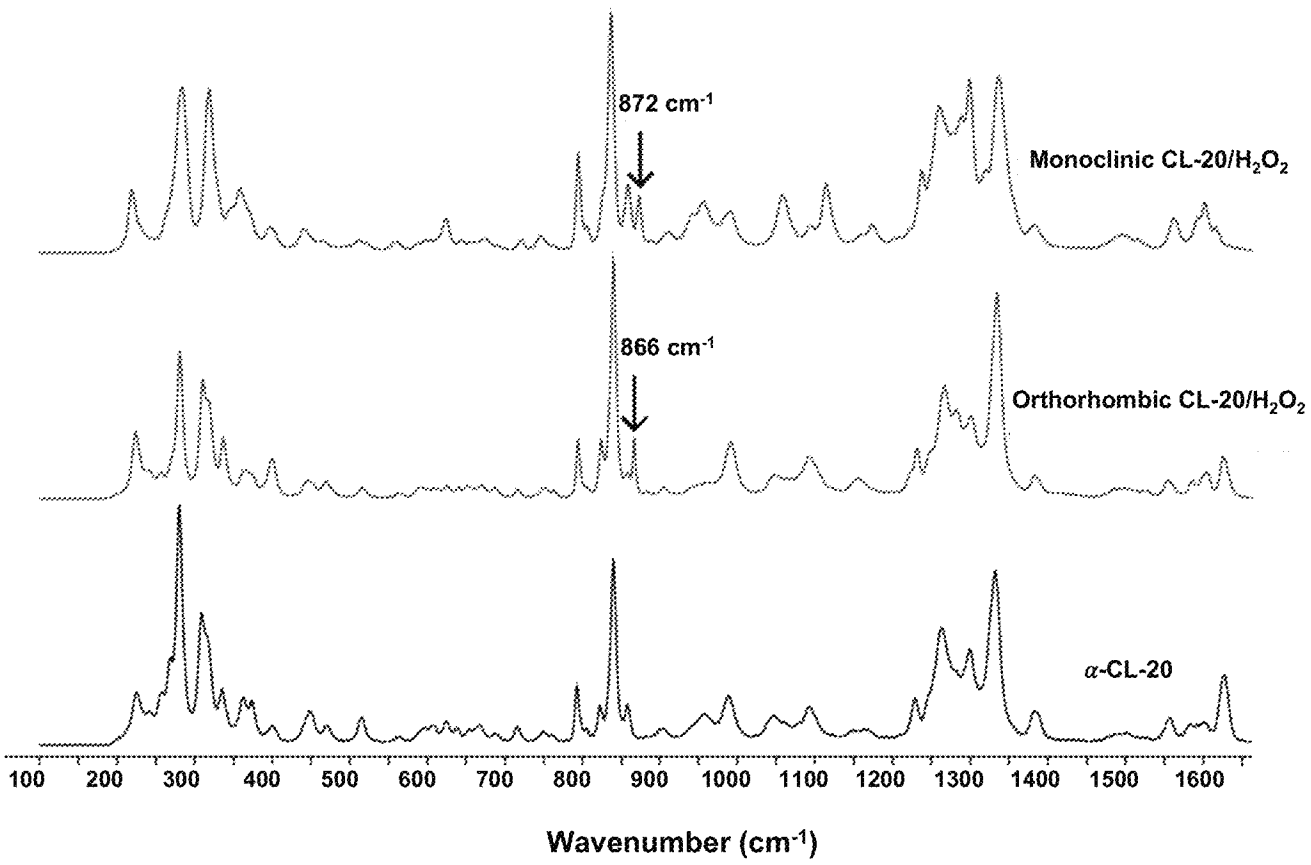
FIG. 3C shows the Raman spectra of FIG. 3B zoomed in (100-1650 $cm^{-1}$). Pure hydrogen peroxide O—O peak is at 879 $cm^{-1}$.

The Raman spectra of both 1 and 2 are compared to all known forms of CL-20 and in particular to α-CL-20. FIG. 3A shows the spectra from 700-1000 cm$^{-1}$, FIG. 3B shows the full range spectra, and FIG. 3C shows the spectra of FIG. 3B zoomed in at 100-1650 cm$^{-1}$. Both 1 and 2 resemble α-CL-20, with the exception of the addition/shifting of the O—O stretch present in the two new solvates. Pure hydrogen peroxide has an O—O stretch at around 879 cm$^{-1}$, while the solvates have an O—O peak shifted to 866 and 872 cm$^{-1}$ respectively for 1 and 2 (FIG. 3A). Additionally, shifting is present in the H—O stretch region for all three materials: α-CL-20 (3610 cm$^{-1}$), 1 (3557 cm$^{-1}$), and 2 (3517 cm$^{-1}$). The addition of the O—O peak and the shifting of the H—O peak in both 1 and 2 is indicative of an interaction between the CL-20 and hydrogen peroxide. For both of the solvates, the higher population of electron density, along with the new and shifted peaks in the Raman spectra, confirms the existence of hydrogen peroxide in these novel materials. The presence of the hydrogen peroxide in the solvates is also quantified by a chemical test wherein the oxidation of triphenylphosphine with hydrogen peroxide to triphenylphosphine oxide is measured by $^{31}$P NMR and the proposed stoichiometry of 2 CL-20 to 1 hydrogen peroxide is confirmed.

Figure 4A:
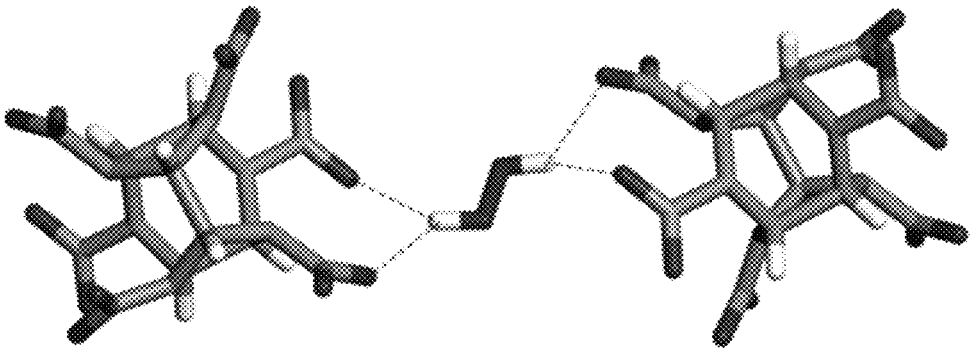
FIG. 4A shows hydrogen bonding interactions between CL-20 and hydrogen peroxide in a 2:1 CL-20/hydrogen peroxide orthorhombic solvate (1).
Figure 4B:
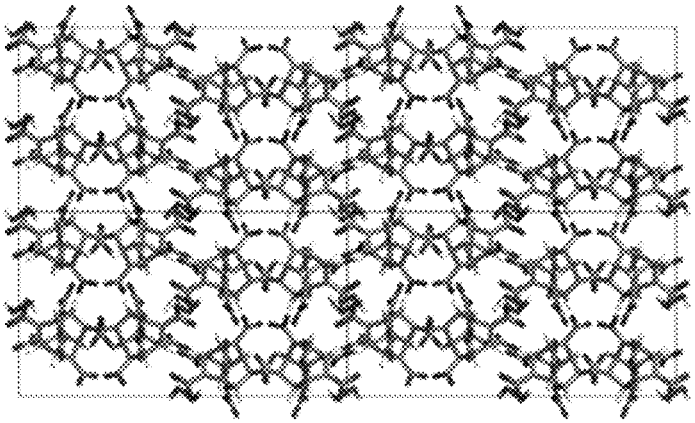
FIG. 4B shows a unit cell viewing down the a-axis for the 2:1 CL-20/hydrogen peroxide orthorhombic solvate (1).
Figure 5A:
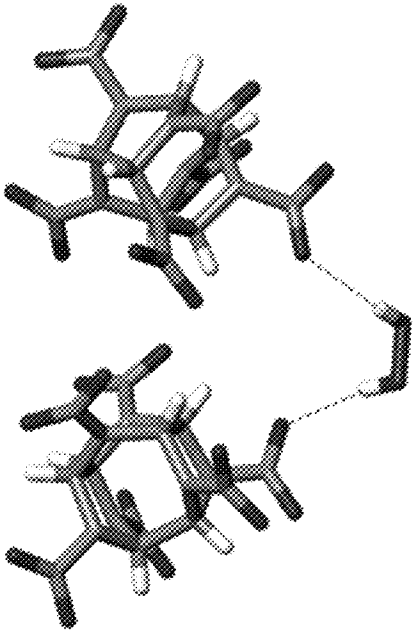
FIG. 5A shows hydrogen bonding interactions between CL-20 and hydrogen peroxide in a 2:1 CL-20/hydrogen peroxide monoclinic solvate (2).
Figure 6A:
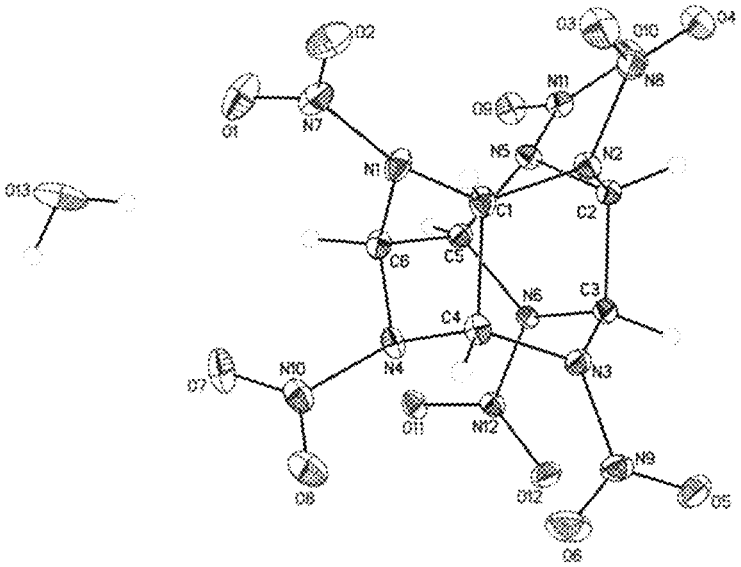
FIG. 6A shows an Oak Ridge Thermal Ellipsoid Plot (ORTEP) diagram for α-CL-20 collected at 85 K with thermal ellipsoids of 50% probability.
Figure 6B:
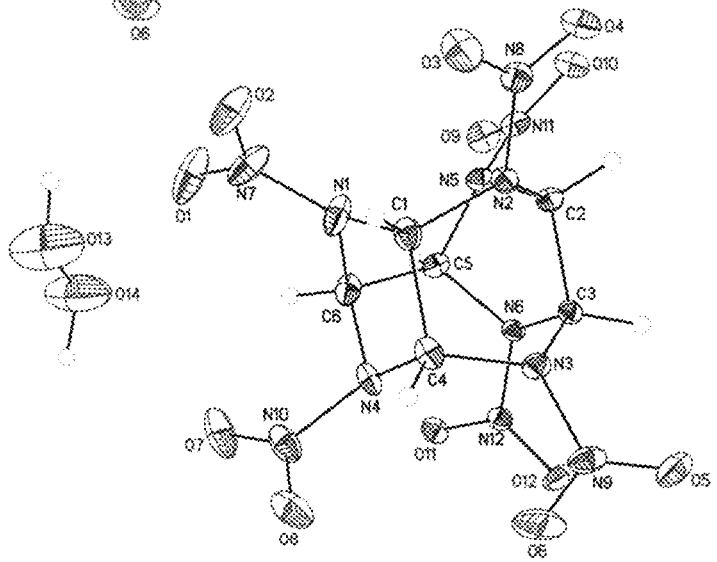
FIG. 6B shows an ORTEP diagram for 1 (orthorhombic) collected at 85 K with thermal ellipsoids of 50% probability.
Figure 6C:
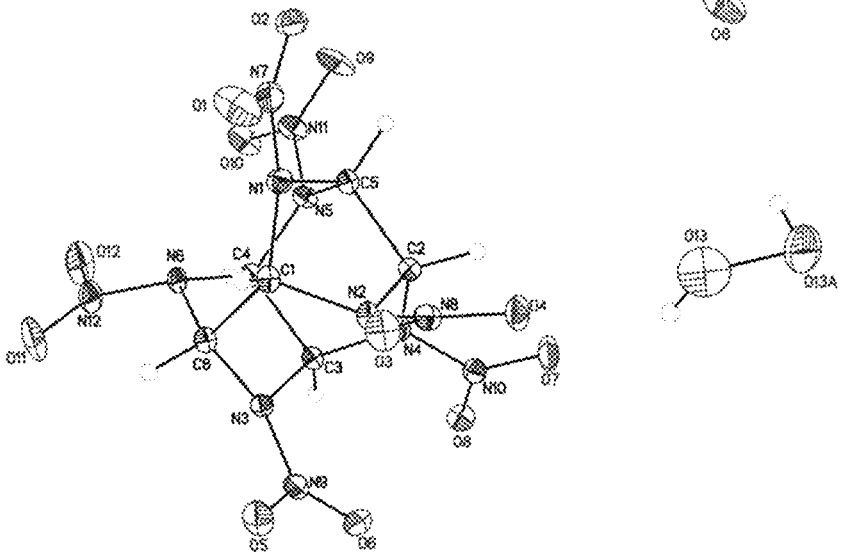
FIG. 6C shows an ORTEP diagram for 2 (monoclinic) collected at 85 K with thermal ellipsoids of 50% probability.

The formation of both CL-20 solvates relies on hydrogen bonding between the hydrogen peroxide and the nitro groups of CL-20 as well as C—H hydrogen bonds between adjacent CL-20 molecules. The shortest interactions between the hydrogen peroxide and CL-20 are highlighted (see FIGS. 4A and 4B and FIGS. 5A and 5B, respectively for solvates 1 and 2). The hydrogen peroxide in 1 hydrogen bonds with two CL-20 molecules and interacts with two nitro groups on each molecule in a bifurcated fashion, with intermolecular distances of 2.17/2.22 Å and 2.19/2.24 Å for each CL-20 molecule (FIG. 4A). In contrast, the hydrogen peroxide in solvate 2 hydrogen bonds with two CL-20 molecules, with an equivalent intermolecular distance of 2.25 Å. In both structures, the CL-20 molecules form linear chains through C—H and nitro hydrogen bonding with adjacent CL-20 molecules; these interactions are reminiscent to those of 1:1 CL-20/TNT and 2:1 CL-20/HMX). The shortest CL-20 C—H . . . $NO_2$ interactions for 1 and 2 are 2.20 Å and 2.23/2.31 Å, respectively. The same linear chain of CL-20 molecules in 1 is also seen in α-CL-20 (2.28 Å). Additionally in the structure of 2, the repeat unit of two CL-20s with one hydrogen peroxide (FIG. 5A) forms a tape that extends through C—H hydrogen bonding between adjacent CL-20 molecules at 2.23 Å. FIGS. 6A, 6B, and 6C, show Oak Ridge Thermal Ellipsoid Plot (ORTEP) diagrams for α-CL-20, 1, and 2, each collected at 85 K with thermal ellipsoids of 50% probability, respectively.

With the structural parameters obtained, the $C_k$ values for these systems are determined for 1, 2, and the pure components ε-CL-20 and α-CL-20. Both solvates 1 (80.6%) and 2 (78.1%) possess $C_k$'s higher than that of the α-CL-20 (77.9%), whereas 1 equals the $C_k$ of ε-CL-20 (80.6%). The difference of the $C_k$ between 1 and α-CL-20 is expected for two reasons: the increased ratio of CL-20/hydrogen peroxide (2:1) compared to the CL-20/$H_2O$ (4:1) and the increased size/volume of the hydrogen peroxide compared to the $H_2O$ molecules. The $C_k$ of solvate 1 equals that of ε-CL-20 through the incorporation of additional oxidizer, while also possessing a density on par to that of ε-CL-20 (2.04 g/cm$^3$).

Figure 7:
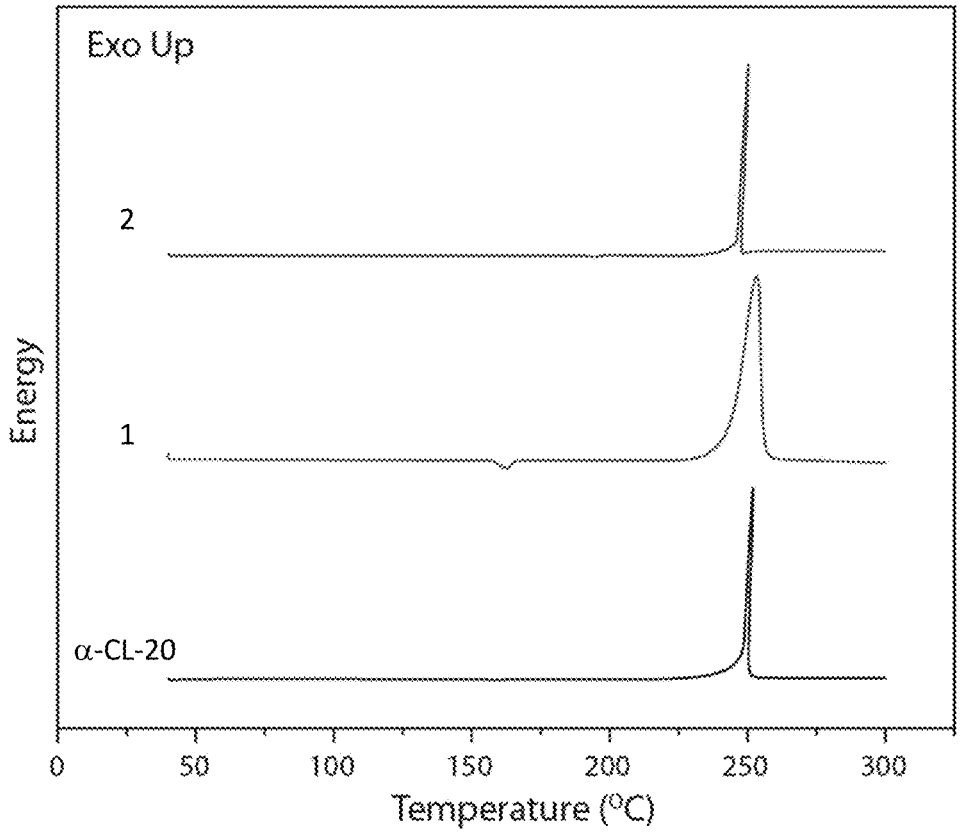
FIG. 7 shows differential scanning calorimetry (DSC) traces of α-CL-20, 1, and 2 (from bottom to top).
Figure 8A:
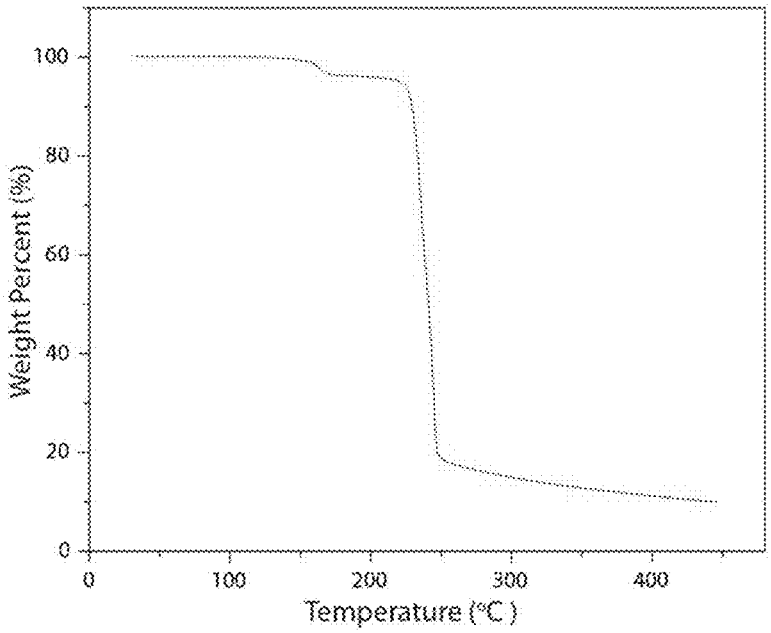
FIG. 8A shows a thermogravimetric analysis (TGA) trace of 1.
Figure 8B:
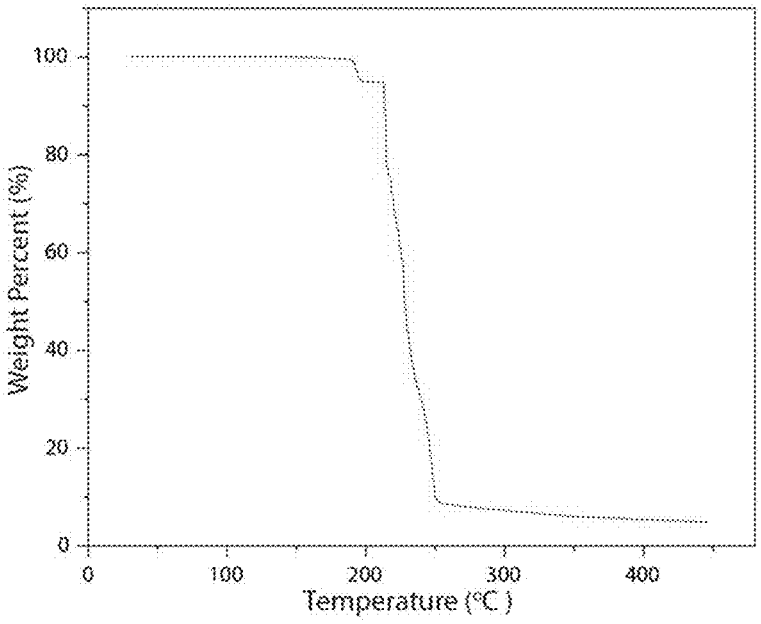
FIG. 8B shows a TGA trace of 2.

The thermal properties of both 1 and 2 are determined via differential scanning calorimetry (DSC) and thermogravimetric analysis (TGA). DSC traces are provided in FIG. 7 and show endothermic peaks at 165, 190 and 158° C. for 1, 2 and α-CL-20 respectively, and decomposition around 250° C. for all three materials. Raman spectroscopy and PXRD are performed after holding the temperature just past the respective endothermic peaks of 1 and 2, and this thermal event is determined to correspond to the release of hydrogen peroxide and subsequent conversion to γ-CL-20. The difference in the desolvation temperature of the two materials arises from the difference in both the hydrogen bonding between the two components and the packing arrangements of the CL-20 molecules in the unit cell; 1 possesses a channel for the hydrogen peroxide to escape from, while the hydrogen peroxide in 2 is contained in a cage of CL-20 molecules. The conversion of the solvates to γ-CL-20 explains why all three materials decompose at the same temperature. Furthermore, FIGS. 8A and 8B provide TGA thermograms showing the loss of hydrogen peroxide at the corresponding endothermic peak temperatures for 1 and 2, respectively. The thermal stability of these materials is an important performance criterion to consider in their application as energetics.

The sensitivity of an energetic material to various external stimuli (impact, friction, electrostatic shock, etc.) is a helpful assessment. The sensitivity of 1 and 2 is determined via small-scale impact drop testing; for reference the Dh50 of ε-CL-20 and β-HMX are 29 and 55 cm, respectively. Solvate formation of CL-20 with hydrogen peroxide results in material 1 possessing sensitivity (24 cm) just below that of ε-CL-20 (29 cm). Solvate 2 possesses sensitivity (28 cm) similar to that of ε-CL-20, yet with an increase to the overall OB of the system. These materials can be classified as sensitive secondary explosives. Currently CL-20 has seen some application in propellants, but with the need of oxidizers in the final formulation. Both 1 and 2 represent materials that, through solvate formation, are able to reduce/eliminate the need for the use of toxic oxidizers like perchlorates in the formulation of CL-20 propellants and should increase its potential utility.

The detonation properties (velocity, pressure, etc.) are calculated using the thermochemical code Cheetah 7.0. Cheetah 7.0 calculations are preformed utilizing the Sandia JCZS product library revision 32. Cheetah calculations require both the chemical (molecular formula/density) and the thermodynamic (heat of formation) properties of a novel energetic material or formulation to predict the detonation velocity/pressure. The cocrystal/solvate performance properties are predicted by treating the materials as a formulation of the two components in their respective molar ratio. For the CL-20 solvates, the room temperature (295 K) densities for each material are used to predict both the detonation velocities and pressures as well as those properties for ε-CL-20, α-CL-20, β-HMX and the 2:1 CL-20/HMX cocrystal (FIG. 9). Both 1 (9606 m/s and 47.005 GPa) and 2 (9354 m/s and 43.078 GPa) have predicted detonation velocities and pressures that outperform α-CL-20, β-HMX and the 2:1 CL-20/HMX cocrystal. The orthorhombic solvate 1 is also projected to surpass the properties of ε-CL-20 (9436 m/s and 45.327 GPa), the gold standard for high performance energetic materials; this feat is accomplished through the incorporation of hydrogen peroxide to increase the overall OB, with little degradation to the sensitivity of the materials.

In conclusion, two polymorphic energetic solvates comprised of 2:1 molar ratios of the high explosive CL-20 and the oxidizer hydrogen peroxide are characterized. Calculated detonation parameters (velocity and pressure) of the two solvates surpass the performance of all known forms of HMX and all low density forms of CL-20, with the orthorhombic solvate 1 expected to exceed the properties of even ε-CL-20. The incorporation of hydrogen peroxide into the crystal system allows for an easy and effective method for the improvement of the detonation properties, without the need for the development of new molecules. By utilizing existing hydrated energetic materials as a guide, the formation of additional isostructural hydrogen peroxide solvates is realized, which possess superior performance to their pure energetic polymorphs.

What is claimed is:

1. A crystalline composition comprising an energetic material and hydrogen peroxide, both having observable electron density in a crystal structure of the composition.

2. The crystalline composition of claim 1, wherein the energetic material is 2,4,6,8,10,12-hexanitro-2,4,6,8,10,12-hexaazaisowurtzita (CL-20).

3. The crystalline composition of claim 2, wherein the crystalline composition has a crystal structure having space group C2/c.

4. The crystalline composition of claim 2, characterized by having a peak in the Raman spectrum at 872 $cm^{-1}$, 3517 $cm^{-1}$, or both.

5. The crystalline composition of claim 2, wherein the crystalline composition has a crystal structure having space group Pbca.

6. The crystalline composition of claim 2, characterized by having a peak in the Raman spectrum at 866 $cm^{-1}$, 3557 $cm^{-1}$, or both.

7. The crystalline composition of claim 1, wherein the energetic material is 5,5'-Dinitro-2H,2H'-3,3'-bi-1,2,4-triazole (DNBT).

8. The crystalline composition of claim 1, wherein the energetic material is an organic nitro compound.

9. The crystalline composition of claim 1, wherein the crystalline composition has an energetic material:hydrogen peroxide ratio of from about 1:1 to about 10:1.

10. The crystalline composition of claim 1, wherein the crystalline composition has an oxygen balance that is higher than a second oxygen balance of a corresponding water solvate comprising the same energetic material, but including water instead of hydrogen peroxide.

11. A composition comprising:

a crystalline solvate comprising:

an organic nitro compound, nitrate ester, nitramine, or azole; and hydrogen peroxide.

12. The composition according to claim 11, wherein the organic nitro compound, nitrate ester, nitramine, or azole is an energetic material selected from the group consisting of 2,4,6,8,10,12-hexanitro-2,4,6,8,10,12-hexaazaisowurtzitane (CL-20); 5-nitro triazol-3-one (NTO); 2,4,6-trinitrotoluene (TNT); 1,3,5,7-tetranitro-1,3,5,7-tetrazocane (HMX); trinitro triamino benzene (TATB); 3,5-dinitro-2,6-bis-picrylamino pyridine (PYX); nitroglycerine (NG); ethylene glycol dinitrate (EGDN); ethylenedinitramine (EDNA); diethylene glycol dinitrate (DEGDN); Semtex; Pentolite; trimethylol ethyl trinitrate (TMETN); tetryl, hexahydro-1,3,5-trinitro-1,3,5-triazine (RDX); pentaerythritol tetranitrate (PETN); 2,2,2-trinitroethyl-4,4,4-trinitrobutyrate (TNETB); methylamine nitrate; nitrocellulose; $N^3,N^3,N'^3,N'^3,N^7,N^7,N'^7,N'^7$-octafluoro-1,5-dinitro-1,5-diazocane-3,3,7,7-tetraamine (HNFX); nitroguanidine; hexanitrostilbene; 2,2-dinitroethene-1,1-diamine (FOX-7); tetranitromethane (TNM); hexanitroethane (HNE); 5,5'-Dinitro-2H,2H'-3,3'-bi-1,2,4-triazole (DNBT); dinitrourea; picric acid; and combinations thereof.

13. The composition according to claim 12, wherein the energetic material is CL-20.

14. The composition according to claim 13, wherein the crystalline solvate has a CL-20:hydrogen peroxide ratio of about 2:1.

15. The composition according to claim 14, wherein the crystalline solvate has a structure that is orthorhombic.

16. The composition according to claim 14, wherein the crystalline solvate has a structure that is monoclinic.

17. The composition according to claim 13, wherein the crystalline solvate has an oxygen balance that is higher than an oxygen balance of each of hydrated CL-20 (α-CL-20) and pure CL-20.

18. A method of making a crystalline solvate containing hydrogen peroxide, the method comprising:

precipitating the solvate from a solution containing the hydrogen peroxide and an energetic material that is a nitrate ester, an organic nitro compound, a nitramine, or an azole.

19. The method according to claim 18, wherein the solution containing the hydrogen peroxide further comprises an organic solvent.

20. The method according to claim 19, wherein the precipitating comprises at least one of lowering a temperature of the solution, adding another solvent in which the energetic material is less soluble to the solution, and evaporating a portion of the organic solvent.

* * * * *